US009677301B2

(12) United States Patent
Zeloof et al.

(10) Patent No.: US 9,677,301 B2
(45) Date of Patent: Jun. 13, 2017

(54) LOCKING COVER FOR CONSTRUCTION VAULT

(71) Applicant: Diversatech, Inc., Pennington, NJ (US)

(72) Inventors: Haskel Zeloof, Stockton, NJ (US); Thomas Vanderpool, Quakertown, PA (US)

( * ) Notice: Subject to any disclaimer, the term of this patent is extended or adjusted under 35 U.S.C. 154(b) by 168 days.

(21) Appl. No.: 14/640,142

(22) Filed: Mar. 6, 2015

(65) Prior Publication Data

US 2016/0258191 A1 Sep. 8, 2016

(51) Int. Cl.

| | |
|---|---|
| ***E05B 65/00*** | (2006.01) |
| ***E02D 29/14*** | (2006.01) |
| ***E05B 35/00*** | (2006.01) |
| ***E05C 3/04*** | (2006.01) |

(52) U.S. Cl.

CPC ..... *E05B 65/006* (2013.01); *E02D 29/14* (2013.01); *E02D 29/1427* (2013.01); *E02D 29/1481* (2013.01); *E05B 35/008* (2013.01); *E05C 3/042* (2013.01)

(58) Field of Classification Search

CPC ... E05C 3/04; E05C 3/02; E05C 19/18; E05C 9/00; E05C 3/042; E05B 65/00; E05B 65/006; E05B 63/14; E05B 35/08; E05B 35/008; B65D 45/24; B65D 55/14; E02D 29/1427; E02D 29/14; E02D 29/1481

USPC ..... 70/166–169; 292/212, 256.5, 256.67, 292/256.71, 256.73, 256.75

See application file for complete search history.

(56) References Cited

U.S. PATENT DOCUMENTS 1,327,011 A * 1/1920 Arndt ..... F16B 2/065 220/328
1,458,391 A * 6/1923 Burton ..... F16J 13/08 137/371
1,473,986 A * 11/1923 Brown ..... E02D 29/1427 292/200
1,551,311 A * 8/1925 Klein ..... E05C 3/042 160/369
1,776,723 A * 9/1930 Craven ..... G01F 15/14 70/168
1,902,731 A * 3/1933 Sherman ..... E02D 29/1427 220/210
2,352,750 A * 7/1944 Witt ..... F16J 13/08 70/168
2,594,012 A * 4/1952 Griffin ..... G01F 15/14 220/210
2,693,100 A * 11/1954 Wiegel ..... E02D 29/1427 292/64
2,873,991 A * 2/1959 Larimore ..... B65D 45/16 27/DIG. 1
3,244,442 A * 4/1966 Arbogast ..... F24C 15/08 292/212
3,443,783 A * 5/1969 Fisher ..... F16B 19/00 248/222.52
4,175,781 A * 11/1979 Dumortier ..... E02D 29/14 292/218
4,492,394 A * 1/1985 Dignan ..... E05C 3/042 292/64
4,861,186 A * 8/1989 Ferns ..... E02D 29/14 404/25

(Continued)

*Primary Examiner* — Suzanne Barrett

(57) ABSTRACT

A locking cover for existing subgrade vault openings. The cover is installed with mounting brackets on side walls of construction vaults and secured with locking latch components secured against flange portions of the mounting brackets.

34 Claims, 7 Drawing Sheets

(56) References Cited

U.S. PATENT DOCUMENTS

| | | | | | |
|---|---|---|---|---|---|
| 5,312,202 | A * | 5/1994 | Newton | E02D 29/14 | 404/25 |
| 5,611,640 | A * | 3/1997 | Bowman | E02D 29/1409 | 404/26 |
| 5,697,729 | A * | 12/1997 | Bowman | E02D 29/1427 | 404/25 |
| 6,007,270 | A * | 12/1999 | Bowman | B65D 90/105 | 404/25 |
| 6,732,555 | B1 * | 5/2004 | Nielsen | E05B 17/2023 | 411/910 |
| 6,739,796 | B1 * | 5/2004 | Del Nero | E02D 29/1427 | 404/25 |
| 7,144,189 | B1 * | 12/2006 | Bongiovanni | B65D 90/105 | 404/25 |
| 7,347,070 | B1 * | 3/2008 | Spector | B65D 55/14 | 404/25 |
| 7,891,904 | B2 * | 2/2011 | Stadler | E02D 29/1427 | 404/25 |
| 7,975,515 | B2 * | 7/2011 | Ygnelzi | E05B 13/001 | 109/52 |
| D671,435 | S * | 11/2012 | Bradley | 137/371 | |
| 2004/0069024 | A1 * | 4/2004 | Hauer | E02D 29/1427 | 70/167 |
| 2005/0241349 | A1 * | 11/2005 | Monneret | E02D 29/1427 | 70/169 |
| 2006/0021396 | A1 * | 2/2006 | Javaux | E02D 29/1427 | 70/168 |
| 2008/0048460 | A1 * | 2/2008 | Brady | E02D 29/124 | 292/256.71 |
| 2011/0303675 | A1 * | 12/2011 | Foster | E05B 35/008 | 220/484 |
| 2014/0311048 | A1 * | 10/2014 | Hill | E02D 29/1445 | 52/19 |

* cited by examiner

COVER TOP

COVER BOTTOM

HORIZONTAL MOUNT

VERTICAL MOUNTS

CORNER LOCKING FLANGE WELDMENT

LOCKING COVER FOR CONSTRUCTION VAULT

BACKGROUND OF THE INVENTIVE FIELD

The present invention is directed to locking covers for vault openings. More particularly, the present invention is directed to a novel cover for existing subgrade vault openings.

Traditional vaults for holding or storing construction equipment and materials (e.g., voltage wires for street lamps) do not have locking mechanisms and are easily broken into. These vaults are subject to burglars who steal the expensive construction materials and devices costing municipalities and states millions of dollars per year. The present invention meets the need for securing these existing subgrade vaults against theft without the need for reconstructing the vault itself.

SUMMARY OF THE GENERAL INVENTIVE CONCEPT

In one embodiment of the present invention, a locking cover apparatus for covering a vault having side walls is comprised of: a cover having a plurality of through holes; a plurality of threaded locking security bolts for placement in the plurality of through holes; a plurality of locking latch components, each having a latch portion and a threaded opening for accepting one of the threaded locking security bolts; a plurality of locking mounting brackets, each having a flange portion at a top portion of each mounting bracket, wherein each of the locking mounting brackets is adapted to attach to one (or two) of the side walls of the vault; wherein each of the locking latch components is configured to rotate when the threaded locking security bolt for each of the locking latch components is rotated, and wherein the cover is locked from removal from the vault when each of the latch portions of the locking latch components is under one of the flange portions.

The foregoing and other features and advantages of the present invention will be apparent from the following more detailed description of the particular embodiments, as illustrated in the accompanying drawings.

BRIEF DESCRIPTION OF THE DRAWINGS

The following detailed description of the example embodiments refers to the accompanying figures that form a part thereof. The detailed description provides explanations by way of exemplary embodiments. It is to be understood that other embodiments may be used having mechanical and electrical changes that incorporate the scope of the present invention without departing from the spirit of the invention.

In addition to the features mentioned above, other aspects of the present invention will be readily apparent from the following descriptions of the drawings and exemplary embodiments, wherein like reference numerals across the several views refer to identical or equivalent features, and wherein.

DETAILED DESCRIPTION OF EXEMPLARY EMBODIMENT(S)

Figure 1A:
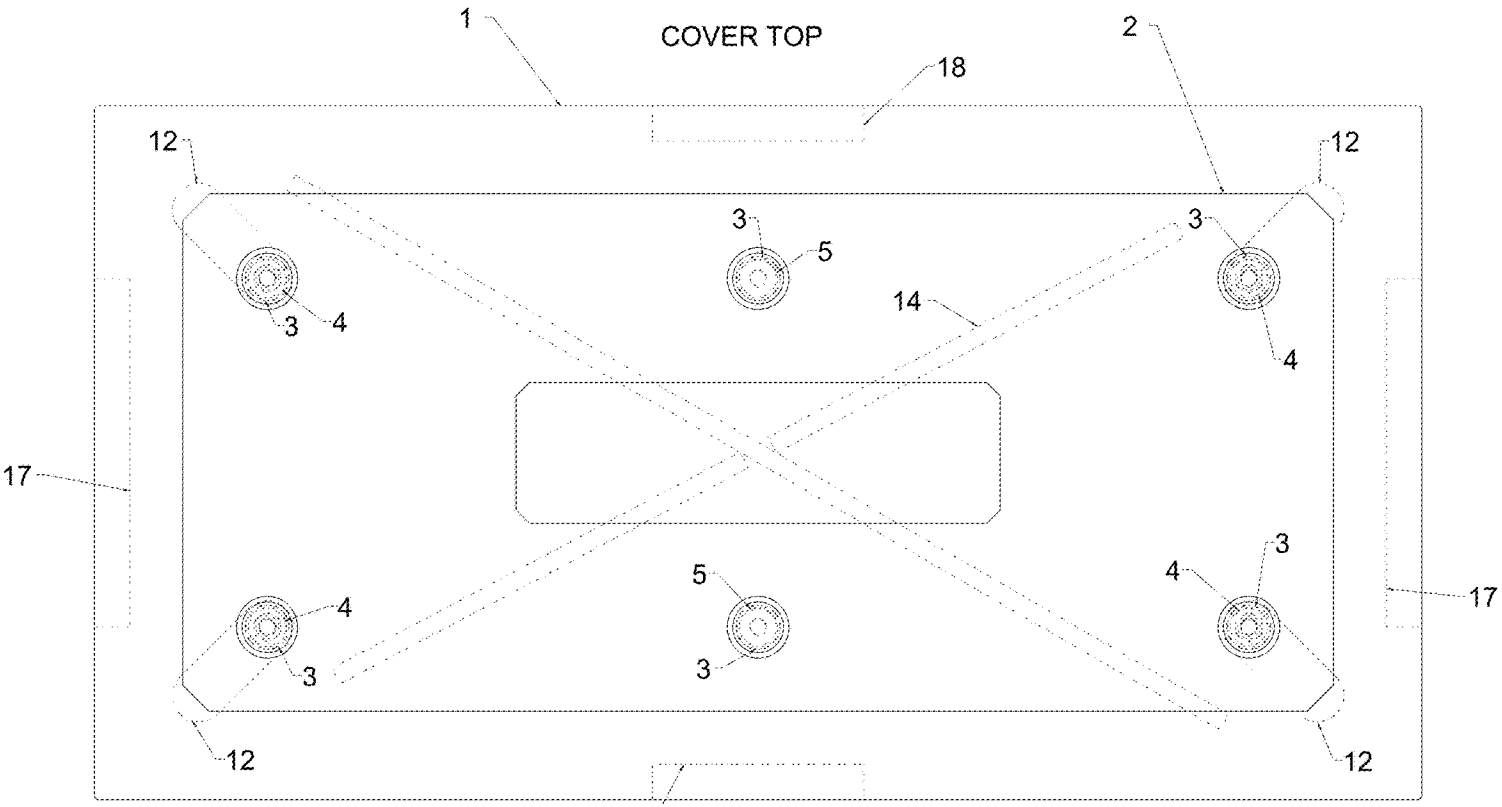
FIG. 1A illustrates one embodiment of a top view of the locking cover of the present invention.
Figure 1B:
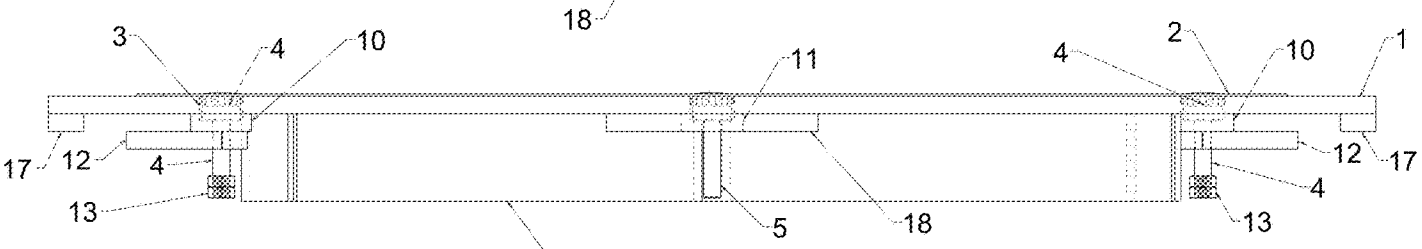
FIG. 1B illustrates one embodiment of a side view of the locking cover of the present invention.
Figure 2:
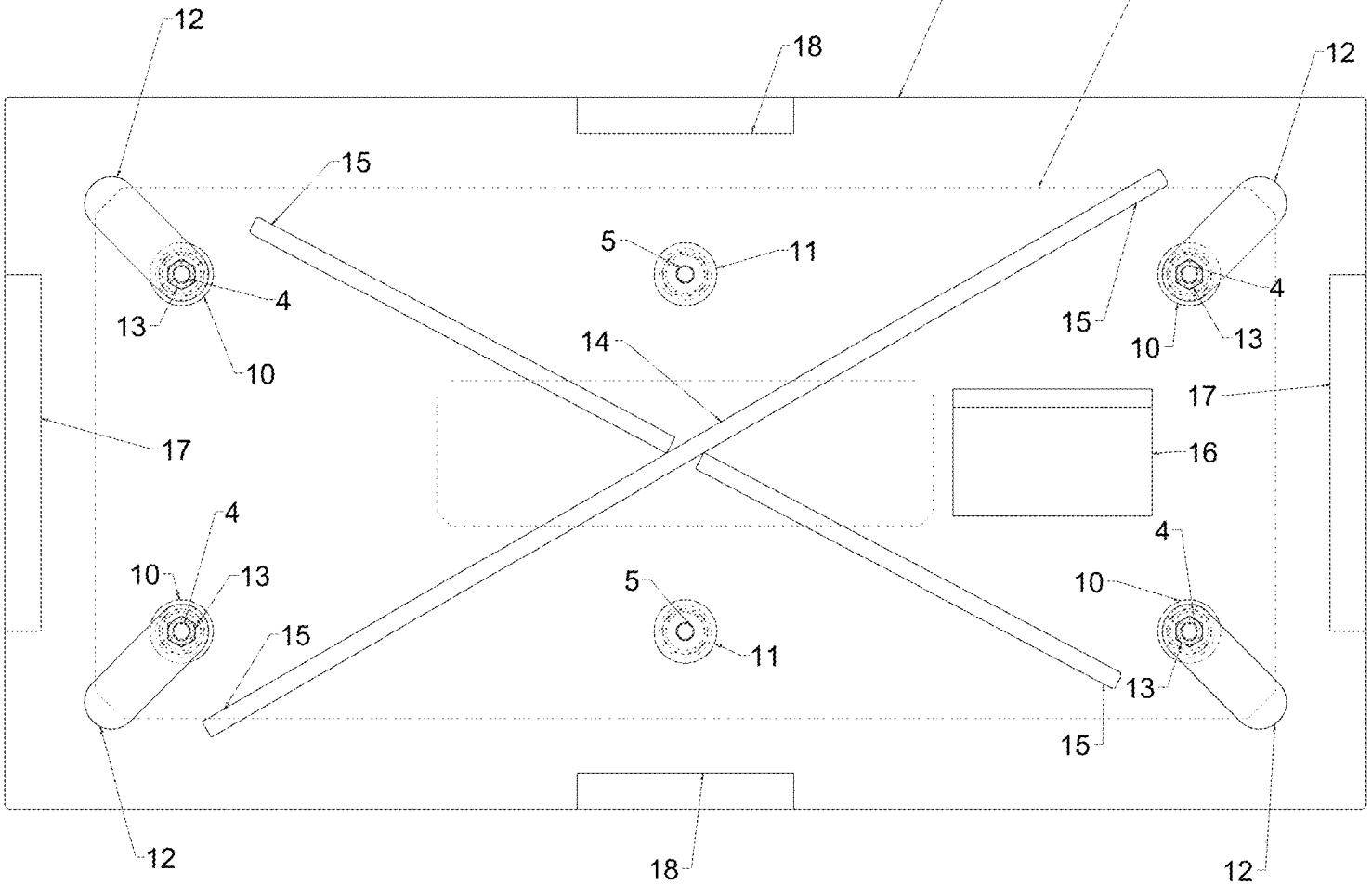
FIG. 2 illustrates one embodiment of a bottom view of the locking cover of the present invention.

FIG. 1A illustrates one embodiment of a top view of the locking cover 1 of the present invention. FIG. 1B illustrates one embodiment of a side view of the locking cover of the present invention. FIG. 2 illustrates one embodiment of a bottom 9 view of the locking cover of the present invention.

A tread plate 2 is preferably constructed from a non-skid, ADA approved surface. For example, the cover can be made from stainless steel, aluminum, cold rolled steel or various other materials. The cover can also be made with various types, patterns, thicknesses and materials. For example, the cover can be constructed of a shatterproof material. In one embodiment, the entire cover and all hardware is made of non-corroding materials that cannot be cut into or compromised by an oxyacetylene torch. The cover can also be configured to meets HS20 loading requirements.

Through holes in the cover 3 provide clearance to permit the diameter of the locking bolt head to pass through, and become recessed below, the cover surface. The locking security bolts 4 are preferably high-security locking bolts (e.g., supplied by McGard Co.).

Figures 3, 4, 5, 6:
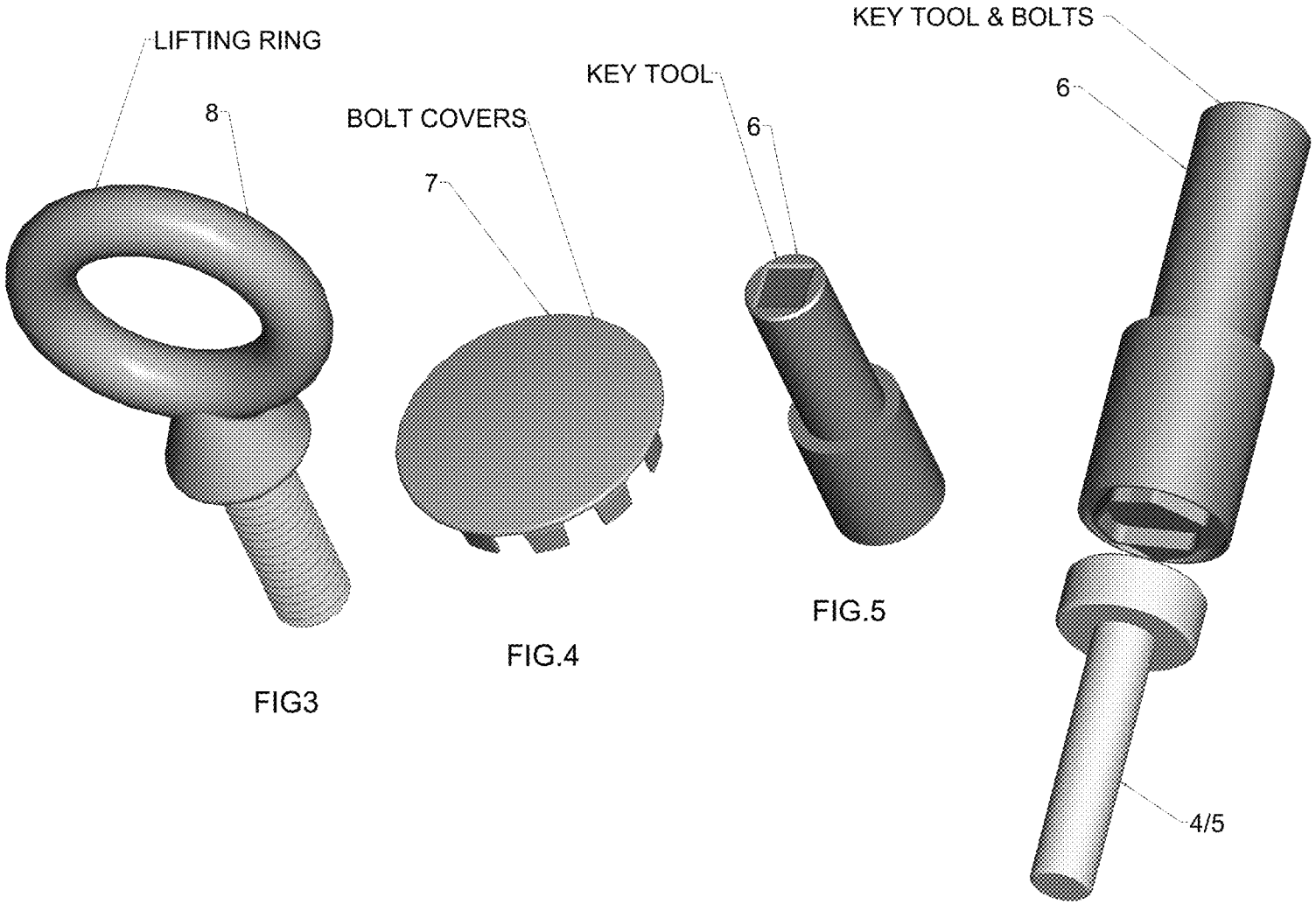
FIG. 3 illustrates one embodiment of a lifting ring of the present invention.
FIG. 4 illustrates one embodiment of a bolt cover of the present invention.
FIG. 5 illustrates one embodiment of a key tool of the present invention.
FIG. 6 illustrates one embodiment of a key tool and locking bolt of the present invention.

FIG. 3 illustrates one embodiment of a lifting ring of the present invention. FIG. 4 illustrates one embodiment of a bolt cover of the present invention. FIG. 5 illustrates one embodiment of a key tool of the present invention. FIG. 6 illustrates one embodiment of a key tool and locking bolt of the present invention. In the preferred embodiment, the locking pattern on the bolts is unique and matched to a corresponding key tool 6. The pattern is registered to the manufacture of the bolt and is not repeated or provided to other customers. The key tool is engaged to the top of the bolt and the outer sleeve is threaded onto the bolt head outside diameter so as to hold the key tool in place during use. In one embodiment, the cover of the present invention provides 4-point security as each corner is secured in place.

Locking lifting bolts 5 are similar to the locking security bolts described above, but are used to conceal two threaded locations which, when the bolts are removed, expose threads which are used for insertion of eyehook lifting rings 8 for use in removal and installation of the cover. When these two bolts are installed, the appearance of two additional locking locations and an illusion of greater security is provided.

Bolt covers 7 are preferably placed on top of the bolts to keep dirt, debris, water, etc. away from the locking security bolts and to prevent corrosion. Unlike existing covers, the cover of the present invention is preferably impenetrable to wildlife and insects such as bees, wasps, snakes, mice, rats, etc., providing a safer environment for workers as well as protecting the conduit and components inside from damage.

There are four counterbored spacers 10, each having a through hole to allow the locking bolts to pass through. The counterbore allows for part of the locking bolt head to be recessed below the ½" cover plate so that none of the locking bolt heads extend above the top surface of the cover.

Lifting bolt spacers 11, similar to the counterbored spacers, are preferably used and the center holes are threaded to accommodate two of the locking security bolts, or lifting rings, as needed. The cover preferably provides an impervious and smooth installation, with no holes or access as in existing units. The locking mechanism is preferably fully recessed and inaccessible by any conventional tool.

Locking flags (or latches) 12 are mechanically and operationally connected to the locking security bolts so that when the threaded locking security bolts are rotated clockwise, the locking flags rotate and hit the stop pin 25 on the corner locking flange weldment and then move up and towards and clamp against the top flange 20. The flag portion (or latch portion) of the locking flag locks the cover in place when placed under the top flange portion of the corner locking flange weldment. In the preferred embodiment, the locking flag has an internal threaded portion that is matched to the locking security bolts. As the locking security bolts are turned, the locking flags rotate. Once the locking flag hits the stop pin, further rotational movement of the locking flag is prevented, however, as the locking security bolt is turned, the locking flag will continue to move upward on the bolt. This latching mechanism does not require adjustment or setting as it automatically stops when tight, unlike other systems. Double jam nuts 13 are used in one embodiment, which are tightened against one another and prevent the locking flags from unthreading and disengaging from the locking security bolt.

A stiffener X brace 14 is attached to the cover in one embodiment. The brace is preferably a welded brace that provides additional strength and load-carrying capacity to the cover. It also acts as a stop for the locking flags during counterclockwise rotation of the locking security bolts allowing the flags to stop rotating and move away from the top flange as the bolt is turned. The brace also protects all of the cover components during removal, handling and shipping, since the components do not extend past the height of the brace.

In one embodiment of the invention (FIG. 2), self-adhesive flag decals 15 are attached depicting proper positioning for each individual locking flag prior to installation of the cover. If each flag is not in the proper position, the stop pins could be engaged on the incorrect side and the locking flags will not correctly mate with the top flange.

Figure 7:
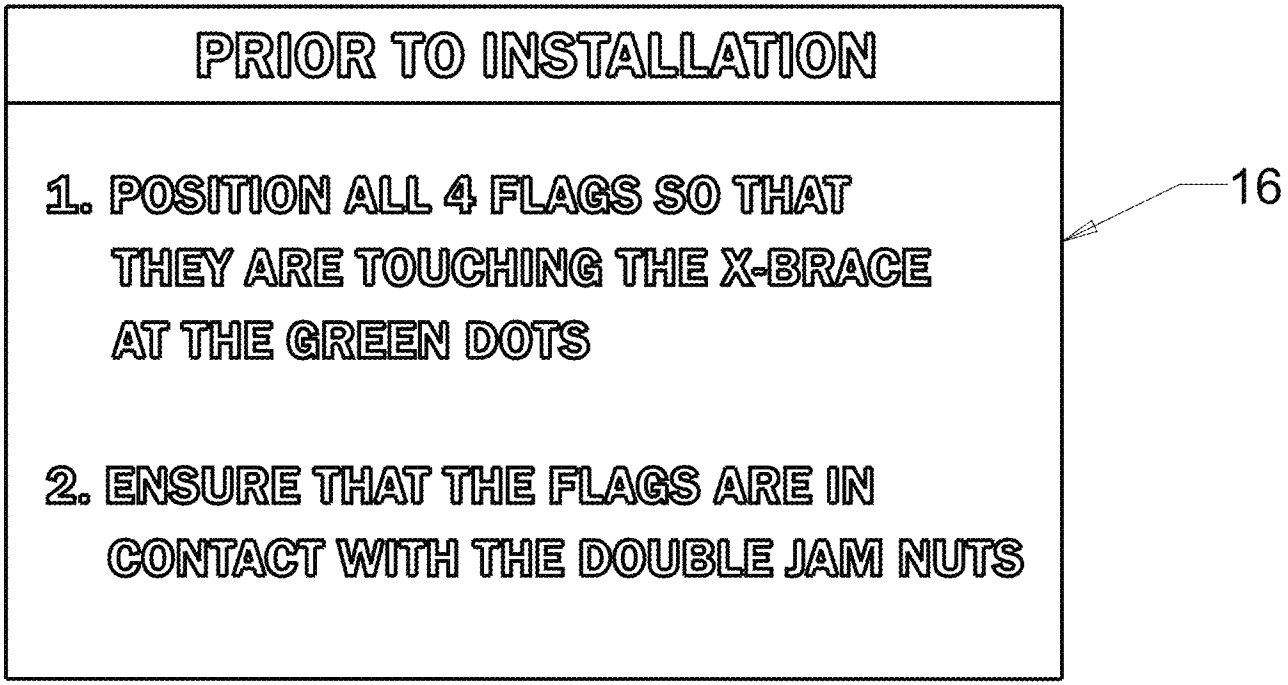
FIG. 7 illustrates one embodiment of a instruction decal.

In one embodiment (FIG. 2), the decals, (placed generally at location 151 are a 1" green dot which acts as an indicator for the flag positioning. Both decals locate the locking flag in the proper orientation for installation. The verbiage on the decal 16 instructs the user to, prior to installation: 1) position all four flags so that they are touching the X-brace at the green dots; and 2) ensure that the flags are in contact with the double jam nuts. FIG. 7 illustrates one embodiment of the instruction decal.

In one embodiment of the invention, end support bars 17 are placed on the bottom of the cover. In this embodiment, because the cover rests upon ½" thick top flanges, these ½" thick spacer end bars provide additional support and load-carrying capacity. (The ½" cover is spaced an additional ½" up to fill the 1" deep space of the existing vault opening (27).) (The lip of the vault (shown at 27) is 1" from the opening of the vault in the embodiment shown (e.g., FIG. 10)).

Side support bars 18 can also be used in addition to the end support bars. Additionally, the end and side support bars provide additional structural support should one or more of the corner locking flange weldments be eliminated due to potential interference with a conduit or other obstruction.

Figure 8C:
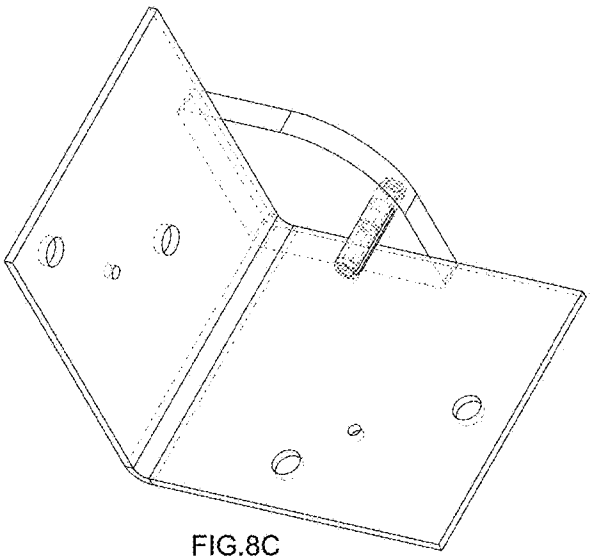
FIG. 8C illustrates an alternate embodiment of a corner locking flange weldment of the present invention having a stop pin and a horizontal mounting bracket.
Figure 8B:
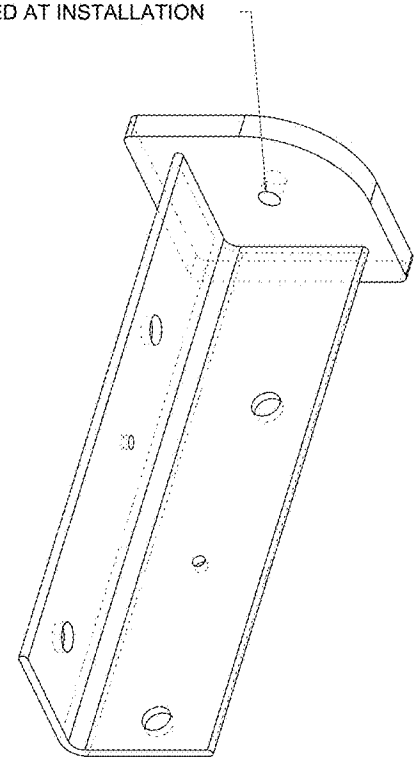
FIG. 8B illustrates an alternate embodiment of a corner locking flange weldment of the present invention having a hole for screwing on the cover.
Figure 8A:
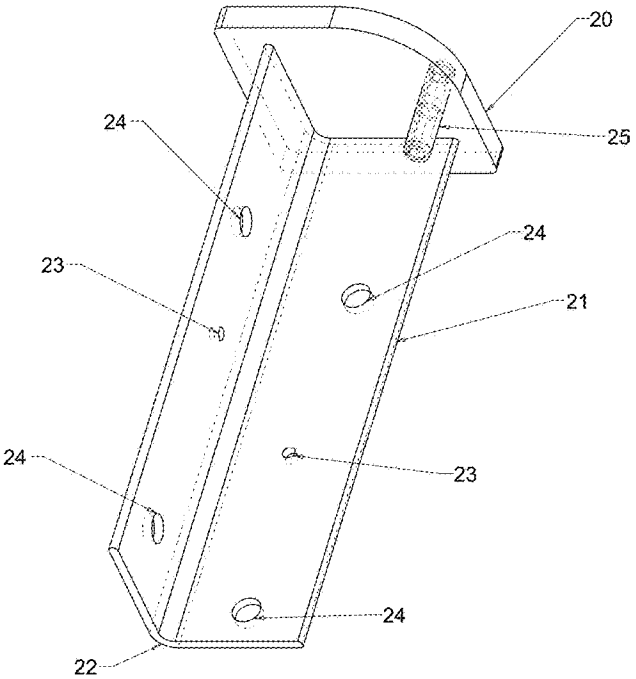
FIG. 8A illustrates one embodiment of a corner locking flange weldment of the present invention having a stop pin and a vertical mounting bracket.

FIG. 8A illustrates one embodiment of a corner locking flange component (e.g., weldment) of the present invention having a stop pin and a vertical mount component. FIG. 8B illustrates an alternate embodiment of a corner locking flange weldment of the present invention having a threaded hole for screwing on the cover. With the embodiment of FIG. 8B, traditional screw hardware is used to screw on the cover in lieu of the corner locking flange components and locking flags as previously described as shown in FIGS. 1-3. In this embodiment, the cover is bolted onto the corner locking flange weldment without the need for the locking flange. FIG. 8C illustrates an alternate embodiment of a corner locking flange weldment of the present invention having a horizontal mount component. The mount components are preferably angle mounting brackets 21 with holes for accepting fasteners.

A top flange 20 is secured, by welding or another method, to the top of the mounting bracket for use in securing the locking latch components and locking the cover as previously described. In other words, once the locking flag is in the locked position under the top flange, the cover cannot be removed from above as the locking flag is secured in place by the top flange. The top flange overhangs the angle mounting bracket (by ⅞" in one embodiment) and allows for positioning of the entire corner locking flange weldment onto the vault opening. In the preferred embodiment, no measuring or positioning of the corner locking flange weldment is necessary; it is self-fixturing.

Since no lip or flange exists in many existing, smooth-walled, concrete vaults, this provision allows the locking flags to rotate into position and pull tight against the top flange to secure the cover. The top flange also acts as a spacer (in one embodiment, the flange is ½" thick allowing the ½" lid to sit flush with the top of the existing vault opening). It is appreciated that different size top flanges may be used with various size vaults and/or covers.

Figure 9:
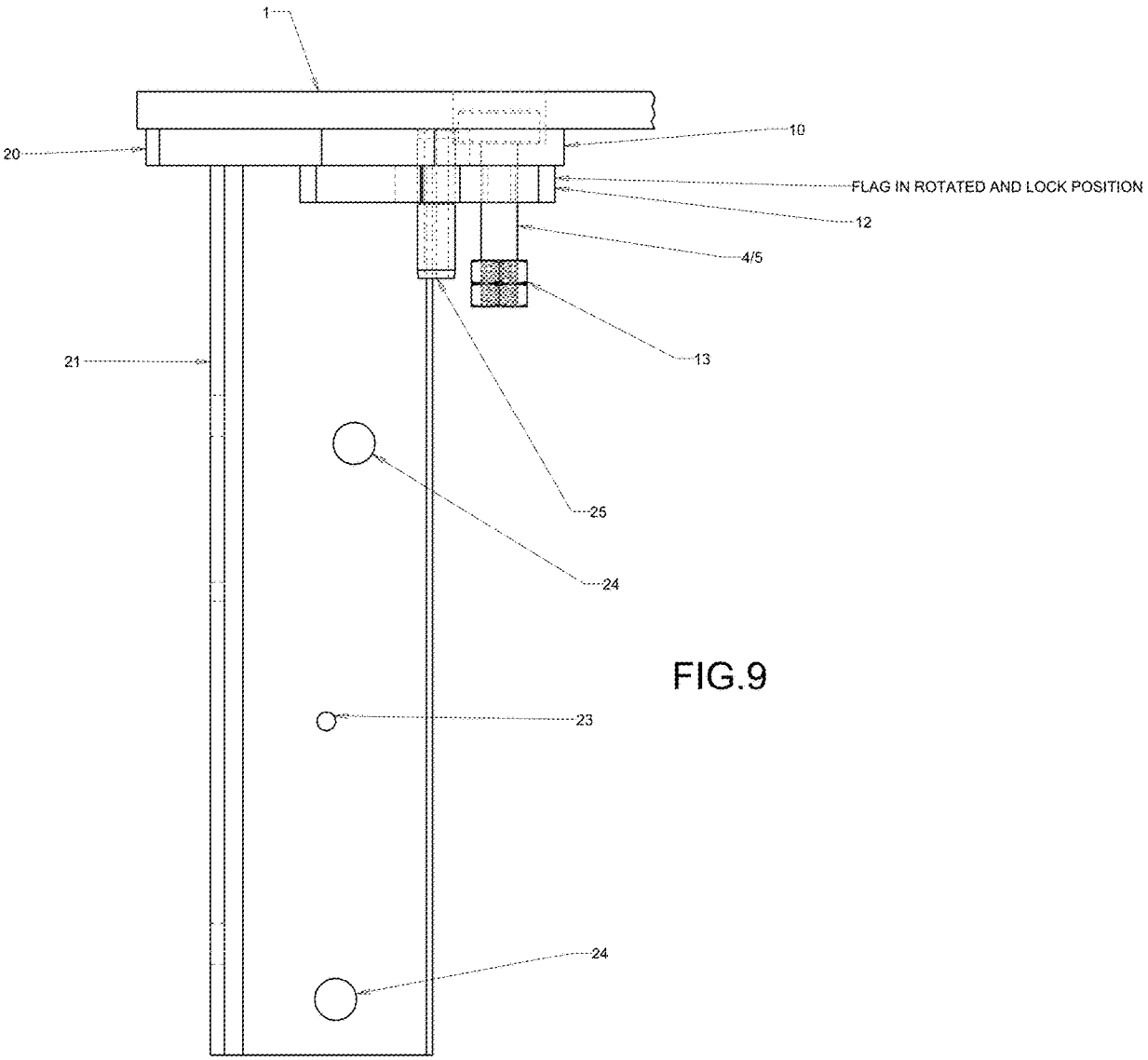
FIG. 9 illustrates one embodiment of a locking flag of the present invention.

The stop pin 25 acts as a stop for the locking flag. When the locking security bolts are rotated clockwise, the locking flag rotates until it comes in contact with the stop pin and cannot rotate further. Its motion then becomes linear and it rises until it comes into firm contact with the top flange securing the cover. FIG. 9 illustrates one embodiment of a locking flag of the present invention in a locked position against the top flange.

The angle mounting bracket is a component of the corner locking flange weldment that allows the component to be securely mounted to existing vault walls. In one embodiment, the angle mounting bracket has a radiused corner 22 to allow for installation against any potential existing debris in the vault opening which could impede installation. The bracket can also be shimmed to fit any wall that is not straight or that is tapered. The design allows for uneven and/or non-plumb conditions and structures which are out of square. The cover can be installed securely with as few as two of the corner locking flange weldments installed diagonally if conditions so require.

In one embodiment of the invention, the corner locking flange weldment is comprised of multiple ¼" positioning holes 23 for insertion of fasteners into the vault wall (e.g., Hilti-type fasteners) to hold the corner locking flange component for final installation (acts like a second set of hands during installation).

In one embodiment, the corner locking flange weldment is comprised of multiple 9/16" mounting holes 24 for securing anchors into the vault wall and for securing the corner locking flange weldment in place. The holes also act as a drill template for the main anchors. There is no measuring required.

Figure 10:
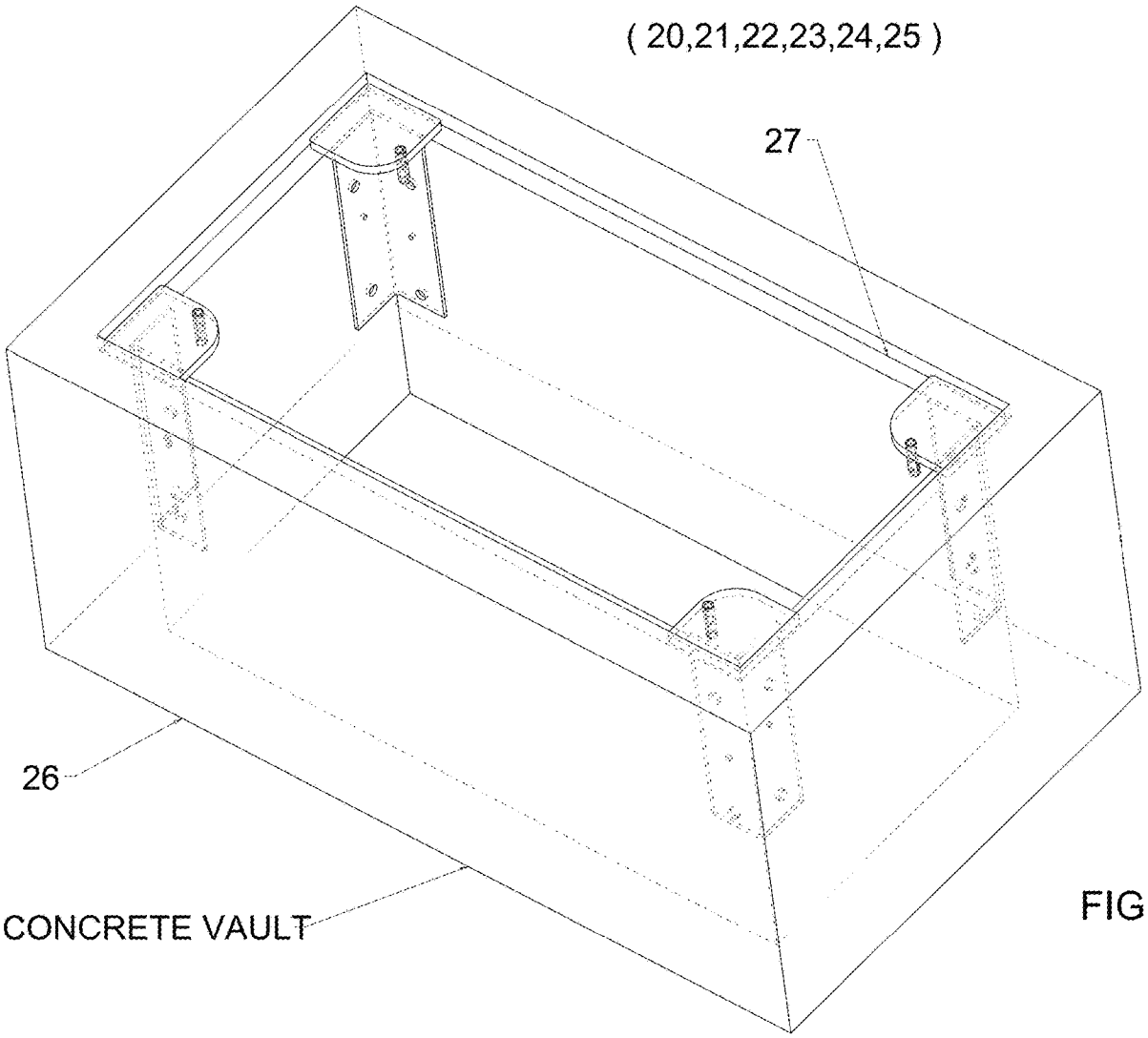
FIG. 10 illustrates one embodiment of a vault assembly of the present invention showing installed corner locking flange weldments.

FIG. 10 illustrates one embodiment of a vault 26 assembly of the present invention. In this embodiment, the vault is an existing concrete vault, although the cover of the present invention can be used with various types of vaults of various sizes and shapes. In this embodiment, the vault has a one inch lip (shown at 27), although the cover of the present invention can be used with vaults without lips.

In an alternative embodiment, the cover of the present invention can be unlocked from the inside, ensuring that no human can be inadvertently locked inside. For example, the cover can be configured so that the lock flags can be easily turned and unlocked from the inside of the vault. For example, in one embodiment of the invention, a safety wrench can be attached to a location on the bottom of the cover which can be used by a person to turn the locking flags to an unlocked position.

While certain embodiments of the present invention are described in detail above, the scope of the invention is not to be considered limited by such disclosure, and modifications are possible without departing from the spirit of the invention as evidenced by the following claims:

What is claimed is:

1. A locking cover apparatus for covering a vault having side walls, the locking cover apparatus comprising:

a cover having a plurality of through holes;

a plurality of threaded locking security bolts for placement in the plurality of through holes;

a plurality of locking latch components, each having a latch portion and a threaded opening for accepting one of the threaded locking security bolts;

a plurality of locking mounting brackets, each having a flange portion at a top portion of each mounting bracket, wherein each of the locking mounting brackets is adapted to attach to one of the side walls of the vault;

wherein each of the locking latch components is configured to rotate when the threaded locking security bolt for each of the locking latch components is rotated, and wherein the cover is locked from removal from the vault when each of the latch portions of the locking latch components is under one of the flange portions.

2. A locking cover apparatus according to claim 1, further comprising:

a stop pin attached to a bottom surface of each of the flange portions for stopping the rotation of the locking latch component.

3. A locking cover apparatus according to claim 1, wherein the vault is square or rectangular in shape having four corners, and wherein there are four locking mounting brackets at each corner of the vault, each operationally connected to a locking securing bolt and a locking latch component.

4. A locking cover apparatus according to claim 1, further comprising:

a plurality of threaded lifting bolts, each configured for placement in one of the through holes in the cover, wherein the threaded lifting bolts are configured so that they can be rotated and removed from the cover and replaced with threaded lifting rings for hooking and lifting the cover.

5. A locking cover apparatus according to claim 1, wherein each of the threaded locking security bolts has a head portion having a key pattern that is matched to a corresponding key tool, and wherein the corresponding key tool for each key pattern is needed to rotate the threaded locking security bolt.

6. A locking cover apparatus according to claim 1, further comprising a plurality of bolt covers for placement into each of the through holes on the cover for preventing water and debris from entering each of the through holes.

7. A locking cover apparatus according to claim 1, further comprising:

a plurality of jam nuts, each jam nut configured for placement on the end of one of the threaded locking security bolts configured to prevent the locking latch components from unthreading and disengaging from each of the threaded locking security bolts.

8. A locking cover apparatus according to claim 1, further comprising:

a stiffener brace in an x-shape attached to the bottom of the cover.

9. A locking cover apparatus according to claim 8, wherein the stiffener brace is attached to the bottom of the cover to protect the locking latch components and the threaded locking security bolts from damage.

10. A locking cover apparatus according to claim 1, further comprising:

side support bars attached to the bottom of the cover for providing additional structural support for the cover.

11. A locking cover apparatus according to claim 1, wherein each of the locking mounting brackets is comprised of an angle mounting bracket with a top flange portion welded to the top of each angle mounting bracket.

12. A locking cover apparatus according to claim 1, wherein each of the locking mounting brackets has a plurality of mounting holes for accepting fasteners.

13. A locking cover apparatus according to claim 1, wherein each of the locking mounting brackets has radiused corners.

14. A locking cover apparatus according to claim 1, wherein the cover has a non-skid tread plate without handles.

15. A locking cover apparatus according to claim 2, wherein each of the locking latch components is configured to move up the threaded locking security bolt that each locking latch component is attached to when the threaded locking security bolt is rotated while the locking latch portion is prevented from rotating by the stop pin.

16. A locking cover apparatus according to claim 15, wherein each of the locking latch components rests against the top flange portion when the cover is in the fully locked stage.

17. A locking cover apparatus for covering a vault having a plurality of side walls and a plurality of corners, the locking cover apparatus comprising:

a cover having a plurality of through holes located at each corner of the cover;

a first locking mounting bracket, having a flange portion at a top portion of the first locking mounting bracket, wherein the first locking mounting bracket is adapted to attach to the side walls of the vault at a first corner of the vault;

a first threaded locking security bolt for placement in one of the through holes at a first corner of the cover;

a first locking latch component, having a latch portion and a threaded opening for accepting the first threaded locking security bolt;

wherein the first locking latch component is configured to rotate when the first threaded locking security bolt is rotated, a second locking mounting bracket, having a flange portion at a top portion of the second locking mounting bracket, wherein the second locking mounting bracket is adapted to attach to the side walls of the vault at a second corner of the vault;

a second threaded locking security bolt for placement in one of the through holes at a second corner of the cover;

a second locking latch component, having a latch portion and a threaded opening for accepting the second threaded locking security bolt;

wherein the second locking latch component is configured to rotate when the second threaded locking security bolt is rotated; and wherein the cover is locked from removal from the vault when the latch portions of the first and second locking latch components are under the flange portions of the first and second locking mounting brackets, respectively.

18. A locking cover apparatus according to claim 17, further comprising:

a first stop pin attached to a bottom surface of the flange portion of the first locking mounting bracket for stopping the rotation of the first locking latch component; and a second stop pin attached to a bottom surface of the flange portion of the second locking mounting bracket for stopping the rotation of the second locking latch component.

19. A locking cover apparatus according to claim 17, wherein the vault is square or rectangular in shape having four corners, and wherein there are four locking mounting brackets at each corner of the vault, each operationally connected to a locking securing bolt and a locking latch component.

20. A locking cover apparatus according to claim 17, further comprising:

at least one through hole on the cover;

at least one threaded lifting bolt, configured for placement in at least one through hole on the cover, wherein the threaded lifting bolt is configured so it can be rotated and removed from the cover and replaced with a threaded lifting ring for hooking and lifting the cover.

21. A locking cover apparatus according to claim 17, wherein each of the threaded locking security bolts has a head portion having a key pattern that is matched to a corresponding key tool, and wherein the corresponding key tool for each key pattern is needed to rotate the locking security bolt.

22. A locking cover apparatus according to claim 17, further comprising a plurality of bolt covers for placement into each of the through holes on the cover for preventing water and debris from entering each of the through holes.

23. A locking cover apparatus according to claim 17, further comprising:

a first jam nut configured for placement on the end of the first threaded locking security bolt and configured to prevent the first locking latch component from unthreading and disengaging from the first threaded locking security bolts.

24. A locking cover apparatus according to claim 17, further comprising:

a stiffener brace in an x-shape attached to the bottom of the cover.

25. A locking cover apparatus according to claim 24, wherein the stiffener brace is comprised of two metal brace portions in an x-shape and wherein the stiffener brace is attached to the cover and configured to act as a stop for each of the locking latch components during counterclockwise rotation of each of the threaded locking security bolts.

26. A locking cover apparatus according to claim 24, wherein the stiffener brace is attached to the bottom of the cover to protect the locking latch components and the threaded locking security bolts from damage.

27. A locking cover apparatus according to claim 17, further comprising:

side support bars attached to the bottom of the cover for providing additional structural support for the cover.

28. A locking cover apparatus according to claim 18, wherein each of the locking latch components is configured to move up the threaded locking security bolt that each locking latch component is attached to when the threaded locking security bolt is rotated while the locking latch portion is prevented from rotating by the stop pin.

29. A locking cover apparatus according to claim 28, wherein each of the locking latch components rests against the top flange portions when the cover is in the fully locked stage.

30. A locking cover apparatus for covering a vault having side walls; the locking cover apparatus comprising:

a cover having a plurality of through holes;

a plurality of threaded locking security bolts for placement in the plurality of through holes;

a plurality of locking latch components, each having a latch portion and a threaded opening for accepting one of the threaded locking security bolts;

a plurality of locking mounting brackets, each having a flange portion at a top portion of each mounting bracket, wherein each of the locking mounting brackets is adapted to attach to one of the side walls of the vault;

wherein each of the locking latch components is configured to rotate when the threaded locking security bolt for each of the locking latch components is rotated, and wherein the cover is locked from removal from the vault when each of the latch portions of the locking latch components is under one of the flange portions;

a stop pin attached to a bottom surface of each of the flange portions for stopping the rotation of the locking latch component;

wherein each of the locking latch components is configured to move up the threaded locking security bolt that each locking latch component is attached to when the threaded locking security bolt is rotated while the locking latch portion is prevented from rotating by the stop pin.

31. A locking cover apparatus for covering a vault having side walls, the locking cover apparatus comprising:

a cover having a plurality of through holes;

a plurality of threaded locking security bolts for placement in the plurality of through holes;

a plurality of locking latch components, each having a latch portion and a threaded opening for accepting one of the threaded locking security bolts;

a plurality of locking mounting brackets, each having a flange portion at a top portion of each mounting bracket, wherein each of the locking mounting brackets is adapted to attach to one of the side walls of the vault;

a stiffener brace in an x-shape attached to the bottom of the cover;

wherein each of the locking latch components is configured to rotate when the threaded locking security bolt for each of the locking latch components is rotated, wherein the cover is locked from removal from the vault when each of the latch portions of the locking latch components is under one of the flange portions, and wherein the stiffener brace is comprised of two metal brace portions in an x-shape and wherein the stiffener brace is attached to the cover and configured to act as a stop for each of the locking latch components during counterclockwise rotation of each of the threaded locking security bolts.

32. A locking cover apparatus according to claim 31, wherein the cover is adapted to cover an opening in the vault and wherein the cover has a top portion, and wherein the vault has a top portion, and wherein each of the flange portions has a top portion, and wherein the plurality of locking mounting brackets are attached to the vault so that the top of the flange portion of each of the locking mounting brackets are recessed lower than the top of the vault so that the top of the vault cover is flush with the top of the vault when the cover rests on the top of the flange portions.

33. A locking cover apparatus according to claim 1, wherein the cover is adapted to cover an opening in the vault and wherein the cover has a top portion, and wherein the vault has a top portion, and wherein each of the flange portions has a top portion, and wherein the plurality of locking mounting brackets are attached to the vault so that the top of the flange portion of each of the locking mounting brackets are recessed lower than the top of the vault so that the top of the vault cover is flush with the top of the vault when the cover rests on the top of the flange portions.

34. A locking cover apparatus according to claim 30, wherein the cover is adapted to cover an opening in the vault and wherein the cover has a top portion, and wherein the vault has a top portion, and wherein each of the flange portions has a top portion, and wherein the plurality of locking mounting brackets are attached to the vault so that the top of the flange portion of each of the locking mounting brackets are recessed lower than the top of the vault so that the top of the vault cover is flush with the top of the vault when the cover rests on the top of the flange portions.

* * * * *